United States Patent [19]

Barasch

[11] 3,948,173

[45] Apr. 6, 1976

[54] MARKING ASSEMBLY

[75] Inventor: Kenneth S. Barasch, South Orange, N.J.

[73] Assignee: Sibar Industries, Wilmington, Del.

[22] Filed: Jan. 8, 1975

[21] Appl. No.: 539,536

Related U.S. Application Data

[63] Continuation-in-part of Ser. No. 478,275, June 11, 1974.

[52] U.S. Cl. ..... 101/333; 101/398

[51] Int. Cl.[2] ..... B41K 1/40; B41K 1/52

[58] Field of Search ..... 101/333, 368, 398, 405, 101/406, 327

[56] References Cited

UNITED STATES PATENTS

| | | | |
|---|---|---|---|
| 265,872 | 10/1882 | Rodwell | 101/333 |
| 677,482 | 7/1901 | Worthington | 101/333 |
| 935,519 | 9/1909 | Kavle | 101/399 |
| 1,275,813 | 8/1918 | Wilday | 101/405 UX |
| 1,920,058 | 7/1933 | Buck | 101/405 |
| 2,778,306 | 1/1957 | Harris | 101/333 |
| 2,791,052 | 5/1957 | Uasel | 101/395 |
| 3,071,071 | 1/1963 | Beaver | 101/380 |
| 3,090,304 | 5/1963 | Suckie | 101/333 |
| 3,119,329 | 1/1964 | Pannier | 101/380 X |
| 3,279,368 | 10/1966 | Wilson | 101/368 X |
| 3,403,623 | 10/1968 | Blackwood | 101/405 |

FOREIGN PATENTS OR APPLICATIONS

| | | | |
|---|---|---|---|
| 767,359 | 1/1957 | United Kingdom | 101/333 |

*Primary Examiner*—J. Reed Fisher
*Attorney, Agent, or Firm*—Oblon, Fisher, Spivak, McClelland & Maier

[57] ABSTRACT

A marking assembly includes a cylindrical member, upon which are supported indicia marking members, and a closure cap, having an ink pad secured therewithin, adapted to be placed over the cylindrical member by means of a coupling which is substantially airtight so as to prevent evaporation of the ink. The indicia members may be removably secured to the cylindrical member by means of a pressure-sensitive adhesive or a snap fitting so as to be readily interchangeable, and the cross-section of the members is sharply tapered so as to produce well-defined sharp images. A further embodiment of the assembly may also include a second closure cap within which is defined a well for housing a small bottle of ink.

6 Claims, 11 Drawing Figures

MARKING ASSEMBLY

CROSS REFERENCE TO RELATED APPLICATIONS

The present application is a Continuation-In-Part of application Ser. No. 478,275, filed June 11, 1974.

BACKGROUND OF THE INVENTION

1. Field of the Invention

The present invention relates generally to printing devices and more particularly to an improved marking assembly which is particularly adapted for imprinting particular indicia upon tennis balls.

2. Description of the Prior Art

Although the printing art is replete with innumerable printing devices, there nevertheless exists a substantial need for a portable marking device or assembly which exhibits the advantages of larger and/or more expensive devices yet none of the disadvantages characteristic thereof, and which furthermore may be particularly adaptable for imprinting particular indicia upon tennis balls.

While one type of portable printing device is known whereby an external supply of ink is desirably rendered unnecessary due to the provision of an ink well within the device, as well as a porous rubber inking pad so disposed as to be in contact therewith when the device is not in use, difficulty has been encountered in controlling the proper amount of ink to be applied to the marking pad, the latter often becoming saturated whereupon contacting the same with the printing member or character, a clean sharp mark often cannot be obtained,especially when the mark is to be imprinted upon a somewhat porous surface, such as for example, paper or fabric. In addition, while attempts have been made to correct the aforenoted drawback through the provision of a suitable valve means interposed between the reservoir or well and the pad, additional difficulties have been encountered in easy and proper operation of the valve so as to furnish a sufficient supply of ink to the pad, and furthermore, the incorporation of a valving device within the printing assembly increases the manufacturing cost thereof.

Similarly, while another type of printing device exhibits the desirable characteristic whereby the particular indicia-bearing members may be interchanged or exchanged so as to vary the particular mark imprinted upon a particular surface, the indicia-bearing members are fabricated so as to be integral members of the entire marking assembly. Depending upon the number of such indicia-bearing members, the size of the entire assembly can become quite considerable whereby the same may no longer remain ideally portable. Still further, the means whereby the indicia are infact able to be retained within the entire assembly necessitates substantially sophisticated fabrication which of necessity increases the costs of manufacture thereof.

Continuing further, while still other types of printing devices are quite simple and inexpensive to manufacture, they do not possess particularly desired characteristics, such as for example, the provision of interchangeable indicia and a sufficient portable supply of ink therefor. In conjunction with the latter characteristic, some types of prior art inking devices, while providing a suitable ink supply for the indicia member, nevertheless fail to supply an adequate cover or closure for the same and consequently the ink supply is permitted to evaporate, and in addition, dust and dirt may enter the enclosure and become deposited upon the printing member and ink supply means whereupon using the printing device, a suitable, clear image of the desired indicia will not in fact be imprinted upon the particular surface or object.

SUMMARY OF THE INVENTION

Accordingly, it is an object of the present invention to provide an improved marking assembly.

Another object of the present invention is to provide an improved marking assembly which overcomes the aforenoted drawbacks of conventional marking devices.

Still another object of the present invention is to provide an improved marking assembly which is portable.

Yet another object of the present invention is to provide an improved marking assembly which is provided with suitable inking means for supplying a sufficient, but not excessive amount of ink to the indicia-bearing member of the assembly.

Yet still another object of the present invention is to provide an improved marking assembly in association with which the indicia-bearing members may be readily exchanged.

A further object of the present invention is to provide an improved marking assembly wherein the indicia members are particularly fabricated so as to achieve clean, sharp images thereof.

A still further object of the present invention is to provide an improved marking assembly wherein the ink utilized is a heavy resin type ink which dries rapidly so as to prevent diffusion and smearing of the same whereupon the imprinted image will not become distorted.

A yet further object of the present invention is to provide an improved marking assembly which is embodied within an enclosure which prevents evaporation of the ink supply.

A still yet further object of the present invention is to provide an improved marking assembly which is simple and relatively inexpensive to manufacture.

The foregoing objectives are achieved according to this invention through the provision of a marking assembly which includes a cylindrical member having an upper platform surface upon which the indicia members may be supported and a closure cap which is adapted to be placed over the upper portion of the pedestal thereby enclosing the indicia members when the pedestal is secured within the cap and is adapted to contact the indicia members when the assembly is closed, the cap being placed upon the cylindrical portion of the assembly with a friction or threaded fitting which is substantially airtight whereby evaporation of the ink from the pad is substantially prevented. The indicia members are removably secured upon the pedestal by means of a pressure-sensitive adhesive or a snap-fitted arrangement and consequently, the indicia may be readily interchanged. In addition, the ink is a heavy-resin type ink which dries rapidly, and as the indicia are substantially tapered in cross-section, a clean, sharp image may be reproduced. In a further embodiment, the lower end of the cylindrical pedestal may be provided with a cylindrical plug with which another closure cap is engageable, the cap being provided with a well within which a small bottle of ink may be housed, the cap thereby sealing the lower end of the assembly and retaining the ink bottle therewithin.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE PREFERRED EMBODIMENTS

Figure 1:
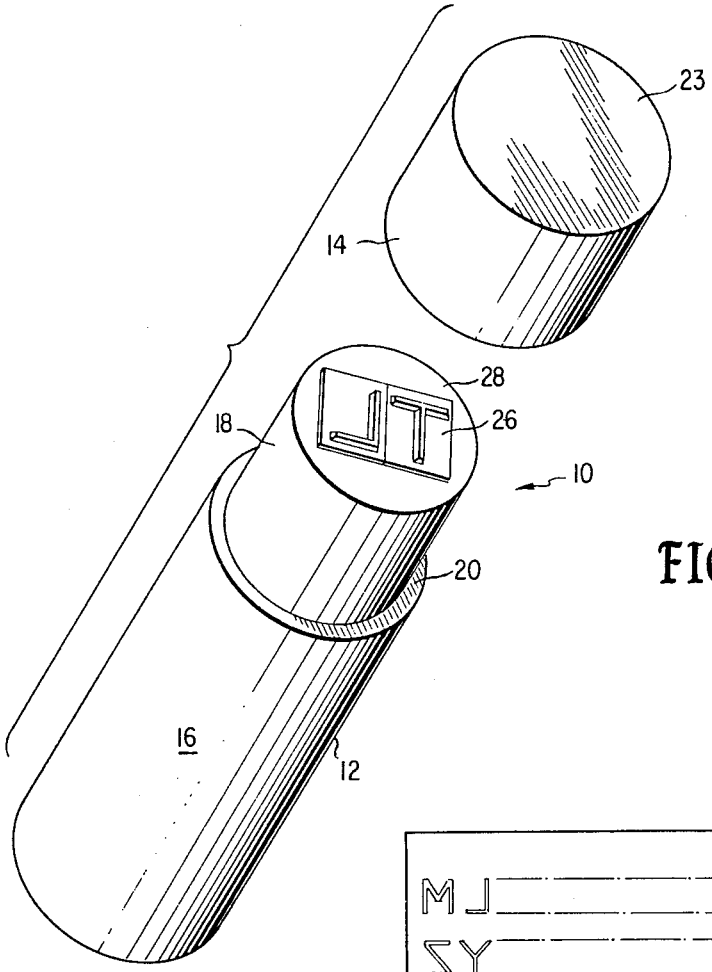
FIG. 1 is an exploded perspective view of a marking assembly constructed according to the present invention and showing its cooperative parts.
Figure 5:
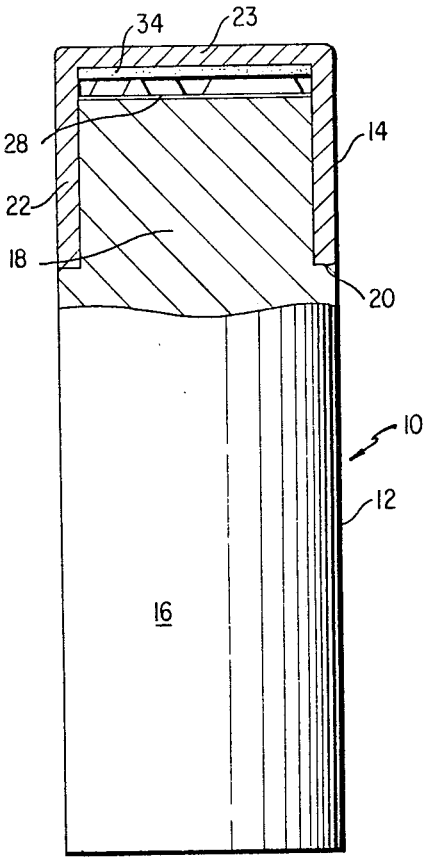
FIG. 5 is a longitudinal cross-section of the assembled marking device of FIG. 1.

Referring now to the drawings and more particularly to FIGS. 1 and 5 thereof, there is shown a tennis ball marking device assembly generally indicated by the reference character 10 and comprising a stepped, cylindrical solid pedestal 12 and an upper closure cap 14 which is adapted to be disposed over and thereby cover the upper end of pedestal 12. Pedestal 12 includes a lower cylindrical portion 16 and an upper cylindrical portion 18 which is integrally formed with portion 16 and which has a diametrical extent somewhat smaller than that of portion 16 whereby an annular shoulder 20, upon which cap 14 is seated and supported, is defined between the outer peripheral surfaces of section 16 and 18. The pedestal 12 and cap 14 may be made of various materials such as for example, a suitable plastic.

Cap 14 includes a dependent annular shift 22 and an end member 23 integrally formed upon the upper portion of skirt 22. The inner diametrical extent of annular member 22 is substantially equal to or slightly greater than that of cylindrical portion 18 of pedestal 12 so as to form a friction fitting or coupling therewith whereby the interior portion of the device is rendered substantially air-tight, and similarly, the outer diametrical extent of member 22 is equal to that of cylindrical portion 16 whereby the outer peripheral surface of device 10 is smooth and continuous throughout the entire longitudinal extent thereof upon assembly of the same, the assemblage in fact resembling a tennis ball can.

Figure 2:
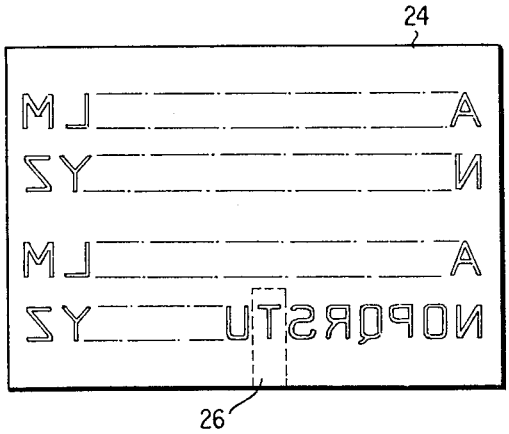
FIG. 2 is a plan view of an adhesively-backed rubber sheet upon which a plurality of embossed letters are fabricated.
Figure 3:
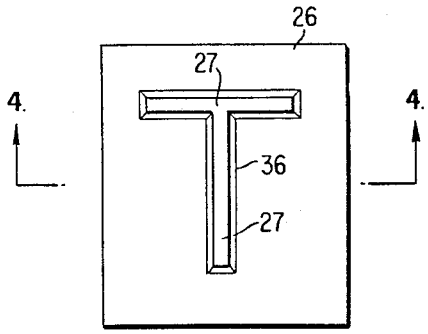
FIG. 3 is a plan view of a single letter which has been severed from the sheet shown in FIG. 2 and which may be secured to the marking device as shown in FIG. 1.

Referring now to FIGS. 2 and 3, a thin, flexible, and resilient planar sheet 24, which may for example, be made of Neoprene rubber, is provided with a plurality of embossed letters, or other suitable indicia not shown, the sheet being readily severable whereby a particular section 26 containing a specifically desired character or indicium 27 such as for example, the letter T, may be removed therefrom for placement upon the upper end planar surface 28 of pedestal cylindrical portion 18. In order to secure one or more of the sections 26 of sheet 24 upon platform 28 the entire rear surface of the sheet is provided with a pressure sensitive backing 30, a conventional coated paper covering 32 in turn being removably secured to adhesive backing 30 in order to protect the same prior to use thereof.

Referring again to FIG. 5, an ink pad 34 which may be made of any one of various fabric materials, is adhesively or otherwise secured to the interior surface of end member 23 of cap 14 and it is to be noted that the depth of cap 14 and more particularly the skirt 22 thereof, is such that upon assembling the device 10, the inner surface of ink pad 34 will contact the upper raised portions of the indicia members 27 whereby such members are always ready for immediate use when cap 14 is removed from assembly 10 and the latter is to be employed for marking the particular indicia upon a tennis ball or other surface. An appropriate supply of ink, such as for example, 8 or 10 drops, may be applied to pad 34 and due to the friction or coupling created between cap 14 and pedestal cylindrical portion 18 and the substantially air-tight enclosure formed thereby, the ink supply will be effectively retained within pad 34.

Figure 4:
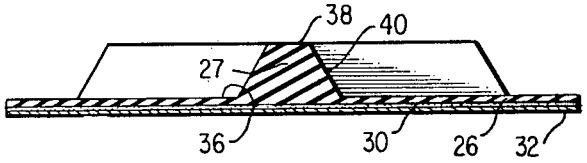
FIG. 4 is a cross-section view of the letter of FIG. 3 taken along line 4—4 of FIG. 3.

In order to insure the fact that the image reproduced upon the tennis ball or other porous surface will be clean and sharp, the printing members or indicia 27 have particular configurations as best illustrated and seen in FIGS. 3 and 4. More specifically, the members 27 are respectively provided with a broad supporting base 36 and a narrow upper die portion 38 which is integrally connected with base 36 through means of upwardly convergent side surfaces 40 whereby the members or indicia 27 have tapered cross-sections, the width of die portion 38 being for example approximately 0.5 mm while the width of base 35, as well as the height of the indicia, may be approximately 2mm. In addition, the quality and clarity of the reproduced image is further enhanced by utilizing a suitable heavy resin type ink which also contains a volatile solvent, the ink thereby being substantially viscous and quick-drying.

In utilizing the marking device of the present invention, previously used indicia members 27 are removed from pedestal platform 28 and newly desired indicia members 27, such as for example, the initials of another person, which may be for example, TL as illustrated in FIG. 1, are severed from sheet 24 and subsequently adhesively secured to platform 28, protective covering 32 having been removed from the pressure-sensitive backing 30. Thereupon, the device 10 is assembled by frictionally coupling cap 14, within which ink pad 34 is fixedly secured, upon pedestal portion 18, ink consequently being transferred from pad 34 to the die surfaces 38 of the indicia members 27. The device 10 may then be disassembled by removing cap 14 from pedestal 12 and subsequently the indicia members 27 impressed upon the particular surface to be marked.

As a result of the impression force, transmitted from pedestal 12 to the indicia members 27, the particular configuration of the members 27 serve to concentrate such forces from the broad base portions 36 thereof to the narrow die portions 38 thereof whereby the latter portions will in fact become somewhat embedded within the surface being marked so as to transfer the ink therefrom to such surface. In addition, as the particular ink utilized dries substantially instantly, a sharp and well-defined image of the indicia members 27 is reproduced upon the surface.

Figure 6:
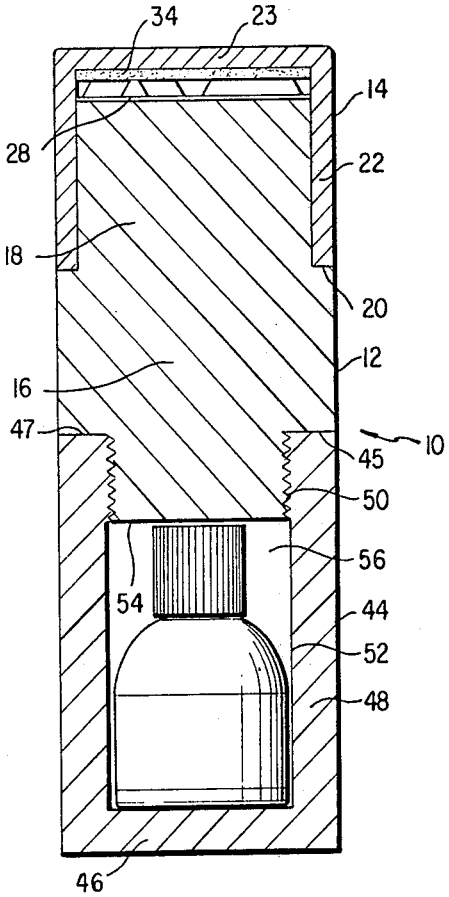
FIG. 6 is a view similar to that of FIG. 5 showing however another embodiment of the marking device assembly of the present invention.

Referring now to FIG. 6, another embodiment of the present invention is illustrated wherein the bottom portion of pedestal section 16 is provided with an axially extending, externally threaded, cylindrical plug 42, and a lower closure cap 44, which includes an end member 45 and an upstanding, annular portion 48 integrally formed with member 46, is adapted to be threadably mated with plug 42 through means of an internally threaded portion 50 provided within the upper part of annulus 48, the upper annular surface 45 of annulus 48 being in abutment with lower annular shoulder portion 47 which is defined between the outer peripheral surfaces of plug 42 and cylindrical member 16.

The outer diametrical extent of cap 44 is equal to that of pedestal portion 16 whereby a smooth and continuous peripheral surface of the device 10 is provided, while the axial extent or depth of cap 44 is substantially greater than that of plug 42 whereby the inner wall surface 52 of cap 44, in conjunction with the lower end surface 54 of plug 42, serves to define a cavity or well 56 within which may be disposed a small bottle of ink 58. It will be readily appreciated that the lower cap 44 may be threadably disassembled from pedestal plug 42 so as to gain access to cavity 56 and ink bottle 58 when replenishment of the ink supply within pad 34 is deemed necessary, and subsequently, the bottle 58 may be redeposited within cavity 56 and cap 44 threadably mated once again upon pedestal plug 42.

Figure 7:
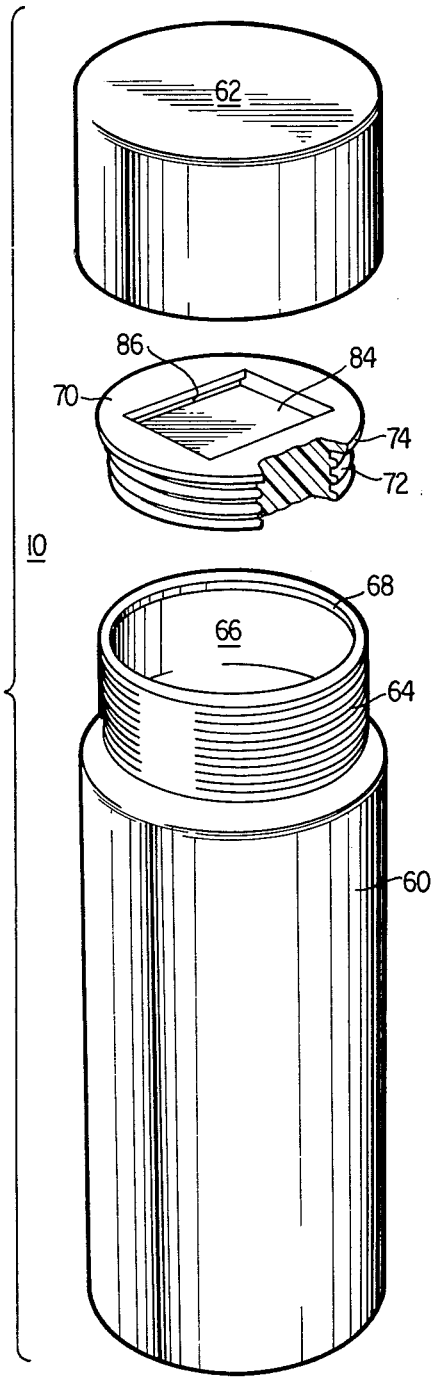
FIG. 7 is a view similar to that of FIG. 1 showing however another embodiment of a marking assembly constructed according to the present invention.

Referring now to FIG. 7, still another embodiment of the present invention is illustrated wherein in lieu of the solid pedestal 12, the assembly 10 may include a hollow cylindrical plastic bottle 60 and a closure cap 62 within which an ink-impregnated pad, not shown, is disposed in a manner similar to that of the previously disclosed embodiments. Bottle 60 includes an externally threaded neck portion 64 while cap 62 is internally threaded so as to be threadedly engaged upon bottle 60 in an air-tight manner, and the outer diameter of cap 62 is substantially the same as that of bottle 60.

The upper end of bottle 60 is open and the mouth 66 thereof is defined by means of a radially inwardly projecting annular lip 68. A disk-type insert 70 having a circumferential dependent skirt 72 is adapted to be inserted within mouth 66 of bottle 60 and in order to secure insert 70 within bottle 60, the external, peripheral surface of skirt 72 includes a plurality of vertically spaced circumferential ribs which are adapted to matingly cooperate with lip 68 of bottle 60 so as to form a friction or snap fitting. A radially outwardly annular flanged portion 74 projecting from the upper portion of insert 70 is adapted to be seated upon the upper surface of lip 68 so as to limit the depth to which insert 70 is deposited within mouth 66.

Figure 8:
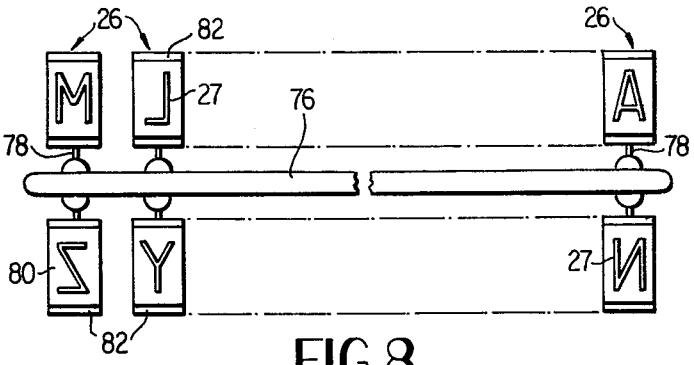
FIG. 8 is a view similar to that of FIG. 2 showing however another embodiment of a letter supply means.
Figure 9:
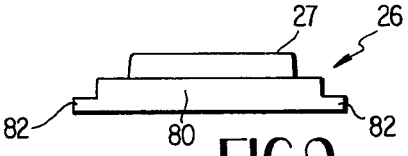
FIG. 9 is an end elevation view of an individual letter section utilized within the marking assembly of FIG. 7.

With reference now being made to FIGS. 8 and 9, it is additionally seen that in lieu of the lettered sheet 24 from which the individual flexible letter sections 26 must be severed, the letters may alternatively be supplied in the form shown in FIG. 8. Individual letter sections 26 are disposed in a linear fashion upon opposite sides of a narrow elongate strip 76 and are secured thereto through means of integrally formed miniscule neck portions 78 which may preferably be scored at the joint lines with sections 26 in order to facilitate separation of a particular letter section 26 from the strip 76. The particular letter indicia 27 are disposed upon a planar base 80 stepped in cross-section which includes flanged portions 82 which project longitudinally from the lower end portions of letter sections 26, and the letter sections 26 are adapted to be secured within the insert 70.

A rectangularly configured centrally depressed or sunken planar portion 84 is defined within the upper planar surface of insert 70 in such a manner that the ends of portion 84 are integrally connected to the inner peripheral surface of skirt 72 while the longitudinal edges thereof are disposed below the upper surface of insert 70 so as to define a pair of longitudinally extending, laterally spaced slots 86 therebetween. The flanged portions 82 of letter sections 26 are adapted to be disposed within slots 86 and portion 84 serves as a support platform for the letter sections.

The distance between slots 86 is substantially equal to the length of the upper portion of stepped base 80, it being apparent that flanged portions 82 will be disposed within slots 86 and below the upper planar surface of insert 70 when the particular letter sections are deposited within the insert, and the length of platform 84 and slots 86 is substantially equal to twice the width of a particular letter section 26 whereby two letter sections 26 may be disposed within insert 70 in a side-by-side fashion.

Figure 10:
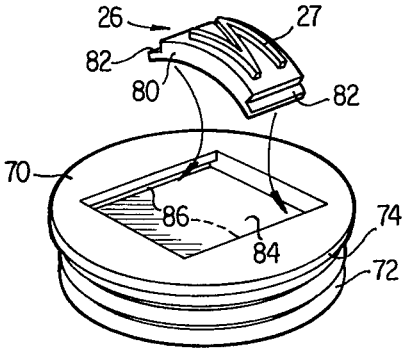
FIG. 10 is a perspective view of an individual letter section being inserted within the platform of the assembly of FIG. 7.
Figure 11:
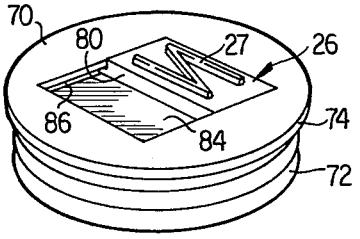
FIG. 11 is a view similar to that of FIG. 10 showing however the letter section deposited within the platform of the assembly of FIG. 7.

With particular reference to FIG. 10, it will be readily apparent that due to the flexibility of the letter sections 26, in order to insert the same within slots 86 of insert 70, the sections 26 may initially be flexed into an arcuate configuration whereupon flanged portions 82 will be permitted to be inserted in a snap-fitted manner within slots 86 and upon so depositing the same therewithin, the particulr letter sections become secured within insert 70 as seen in FIG. 11 due to the resilience inherent within the rubber material from which sections 26 are formed tending to return the same to its original planar disposition. In order to remove a particular letter section and exchange the same with another section, the section within insert 70 may be simply flexed in a manner similar to that employed in initially inserting the letter section within insert 70 so as to disengage flanged portions 82 from slots 86.

Thus, it may be seen that the marking device assembly of the present invention has important advantages over the known prior art structures in that the device is truly portable in that the indicia inking means and an ink supply may be embodied within the device, the device is simple and inexpensive to manufacture due to the unique means of exchanging the indicia memers, and an adequate supply of ink is maintained within the device and transferred to the indicia members and the members have particular configurations whereby a well-defined and sharp image is reproduced upon the surface to be marked.

Obviously, many modifications and variations of the present invention are possible in light of the above teachings such as for example the fact that in lieu of the disclosed adhesive or snap-fitted indicia members, slidable members may likewise be incorporated within the marker. Still further while a cylindrical elongated member is disclosed, rectangular or square members may also be utilized. It is to be understood therefore that within the scope of the appended claims the present invention may be practiced otherwise than as specifically described herein.

What is claimed as new and desired to be secured by Letters Patent of the United States is:

1. A marking assembly comprising:

an elongated hollow container-type member open at one end thereof so as to define a cavity therein and including a first portion having a first diametrical extent and a second portion integrally formed with said first portion and having a second diametrical extent which is less than that of said first portion, said open end being defined within said second portion;

insert support means snap-fitted within the open end of said member so as to enclose said cavity and having a support surface upon which indicia marking means may be supported, slot means being defined within said insert upon opposite sides of said support surface;

indicia marking means having flanged means projecting from opposite sides thereof adapted to be disposed within said insert slot means in a snap-fitted manner for removably securing said indicia marking means upon said insert support surface whereby said indicia marking means may be selectively interchanged;

a closure cap having an end member and adapted to be secured in an air-tight manner over said second portion, said support means, and said indicia marking means, said cap having an inside diameter substantially equal to that of said second portion of said member while the outside diameter of said cap is substantially equal to that of said first portion whereby said assembly has a substantially smooth and continuous external surface over the entire extent thereof so as to be readily portable; and inking pad means fixedly secured within said cap and upon the interior surface of said end member for inking said indicia marking means when said cap is secured upon said support means, the interior depth of said cap extending from the open end thereof to said pad being substantially equal to the height of said second portion of said member plus the height of said indicia marking means whereby, when said cap is placed upon said member, said ink pad means will be in contact with said indicia marking means for inking the same.

2. A marking assembly as set forth in claim 1 wherein:

said closure cap is frictionally connected to said support means.

3. A marking assembly as set forth in claim 1 wherein each of said indicia marking members comprise:

a broad planar base supporting portion;

a narrow die marking portion; and side portions interconnecting said base and die portions which converge from said base portion to said die portion, each of said members thereby having a tapered cross-section whereby a well-defined and sharp image is formed.

4. A marking assembly as set forth in claim 1 wherein said inking means is an ink pad impregnated with a supply of ink.

5. A marking assembly as set forth in claim 1 wherein:

said indicia marking means may be made of neoprene rubber.

6. A marking assembly as set forth in claim 1 wherein:

said closure cap is threadedly engaged upon said cylindrical member.

* * * * *